US012600548B2

(12) United States Patent
Kato et al.

(10) Patent No.: US 12,600,548 B2
(45) Date of Patent: Apr. 14, 2026

(54) HARD CONTAINER AND DEVICE COMPRISING SAME

(71) Applicant: KYORAKU CO., LTD., Kyoto (JP)

(72) Inventors: Takayuki Kato, Yamato (JP); Takeru Sano, Yamato (JP); Kentaro Uchihashi, Yamato (JP)

(73) Assignee: KYORAKU CO., LTD., Kyoto (JP)

( * ) Notice: Subject to any disclaimer, the term of this patent is extended or adjusted under 35 U.S.C. 154(b) by 63 days.

(21) Appl. No.: 17/921,155

(22) PCT Filed: Apr. 26, 2021

(86) PCT No.: PCT/JP2021/016575
§ 371 (c)(1),
(2) Date: Oct. 25, 2022

(87) PCT Pub. No.: WO2021/221004
PCT Pub. Date: Nov. 4, 2021

(65) Prior Publication Data

US 2023/0174283 A1 Jun. 8, 2023

(30) Foreign Application Priority Data

Apr. 30, 2020 (JP) ..... 2020-080712

(51) Int. Cl.
*B65D 77/06* (2006.01)

(52) U.S. Cl.
CPC ..... *B65D 77/06* (2013.01); *B65D 2577/041* (2013.01)

(58) Field of Classification Search
CPC . B05B 11/0038; B05B 11/1001; B65D 23/02; B65D 2577/041; B65D 77/06; B65D 83/0061
(Continued)

(56) References Cited

U.S. PATENT DOCUMENTS 6,672,479 B2 1/2004 Shiraishi et al.
2012/0174919 A1* 7/2012 Hausmann ..... A61M 11/06 128/200.23
(Continued)

FOREIGN PATENT DOCUMENTS

AU 646126 B2 2/1994
JP 2003-276719 A 10/2003
(Continued)

OTHER PUBLICATIONS

International Search Report issued on Jun. 8, 2021 in corresponding International Application No. PCT/JP2021/016575; 5 pages.
(Continued)

*Primary Examiner* — Nathan J Jenness
*Assistant Examiner* — Madison L Poos
(74) *Attorney, Agent, or Firm* — Maier & Maier, PLLC

(57) ABSTRACT

Provided is a hard container capable of appropriately discharging or spraying content. The present invention provides a resin-made hard container for use with a suction device attached thereto that is configured to discharge or spray suctioned content. The hard container is provided with a container body having an outer shell and an inner bag. The container body is configured such that the inner bag contracts as the content is reduced. An innermost layer of the outer shell comprises an EVOH layer.

15 Claims, 10 Drawing Sheets

(58) Field of Classification Search
USPC ..... 220/495.01
See application file for complete search history.

(56) References Cited

U.S. PATENT DOCUMENTS

| | | | | |
|---|---|---|---|---|
| 2015/0040890 | A1* | 2/2015 | Besseler | A61M 15/0038 128/200.14 |
| 2017/0029156 | A1 | 2/2017 | Eguchi et al. | |
| 2017/0305122 | A1 | 10/2017 | Akiyama et al. | |
| 2018/0162580 | A1* | 6/2018 | Nyuu | B32B 33/00 |
| 2018/0327130 | A1 | 11/2018 | Taruno | |
| 2019/0241303 | A1* | 8/2019 | Eguchi | B65D 1/02 |

FOREIGN PATENT DOCUMENTS

| | | | | |
|---|---|---|---|---|
| JP | 2004-42942 | A | 2/2004 | |
| JP | 200442942 | * | 2/2004 | |
| JP | 2006-21409 | A | 1/2006 | |
| JP | 2006021409 | * | 1/2006 | |
| JP | 2011068373 | A | 4/2011 | |
| JP | 2015-163531 | A | 9/2015 | |
| JP | 2016-69038 | A | 5/2016 | |
| JP | 2016-104644 | A | 6/2016 | |
| JP | 2018-203373 | A | 12/2018 | |
| WO | WO-9211187 | A1 * | 7/1992 | B01D 21/01 |
| WO | WO-2019004028 | A1 * | 1/2019 | B65D 1/02 |
| WO | 2022059715 | A1 | 3/2022 | |

OTHER PUBLICATIONS

Extended Search Report issued on Sep. 14, 2023, in corresponding European Application No. 21796235.6, 7 pages.
Office Action issued on Oct. 31, 2024, in corresponding Chinese Application No. 202180028811.0, 17 pages.
Office Action issued on May 30, 2025, in corresponding Chinese Application No. 202180028811.0, 20 pages.

* cited by examiner

HARD CONTAINER AND DEVICE COMPRISING SAME

TECHNICAL FIELD

The present invention relates to a resin-made hard container for use with a suction device attached thereto that is configured to discharge or spray suctioned content.

BACKGROUND ART

Conventionally, a delaminatable container that suppresses air from entering inside thereof by contraction of an inner bag along with a reduction in content (e.g., Patent Literature 1) has been known. The delaminatable container disclosed in Patent Literature 1 has the inner bag provided with an EVOH layer to enhance gas barrier property and detachability.

CITATION LIST

Patent Literature

[Patent Literature 1] Japanese Unexamined Application Publication No. 2015-163531

SUMMARY OF INVENTION

Technical Problem

Incidentally, a delaminatable container as disclosed in Patent Literature 1 is often used with a suction device attached thereto that is configured to discharge or spray suctioned content. In this case, an outer shell will be hard for reasons such as attachability enhancement of the suction device. However, the content was sometimes not discharged or sprayed appropriately when the delaminatable container was used with the suction device attached thereto.

The present invention has been made by taking these circumstances into consideration. The present invention provides a hard container capable of appropriately discharging or spraying content.

Solution to Problem

According to the present invention, a resin-made hard container for use with a suction device attached thereto, the suction device configured to discharge or spray suctioned content, the hard container comprising a container body having an outer shell and an inner bag, wherein the container body is configured such that the inner bag contracts as the content is reduced; and an innermost later of the outer shell comprises an EVOH layer, is provided.

The present inventors have considered root cause of inappropriate discharging or spraying content in the case that a delaminatable hard container is used with a suction device attached thereto and have found that insufficient flexibility of the inner bag leads to inappropriate contraction of the inner bag. The present inventors have also found that providing the innermost layer of the outer shell with the EVOH layer can enhance flexibility of the inner bag as well as keep gas barrier property and detachability, thereby leading to completion of the invention.

The following are examples of various embodiments of the present invention. The embodiments shown below can be combined with each other.

Preferably, the outer shell comprises a homopolypropylene layer outside of the innermost layer.

Preferably, the inner bag does not comprise the EVOH layer.

Preferably, the inner bag is constituted of a polyolefin layer.

Preferably, content amount is 1 to 10 mL.

Preferably, elastic modulus gradient of the container body is 20 N/mm or above.

Preferably, ethylene content of an EVOH resin that constitute the EVOH layer is 32 mol % or below.

According to the present embodiment, a device having the above-mentioned hard container, the device comprising a suction device attached to the hard container, wherein the suction device is configured to discharge or spray content suctioned from the hard container, is also provided.

Preferably, the suction device has discharge or spray amount of 10 to 50 μL for one time.

DESCRIPTION OF EMBODIMENTS

Hereinafter, embodiments of the present invention will be explained. Various distinctive features shown in the following embodiments can be combined with each other. In addition, an invention can be established independently for each of the distinctive features.

The First Embodiment (Hard Container 1)

Figure 1:
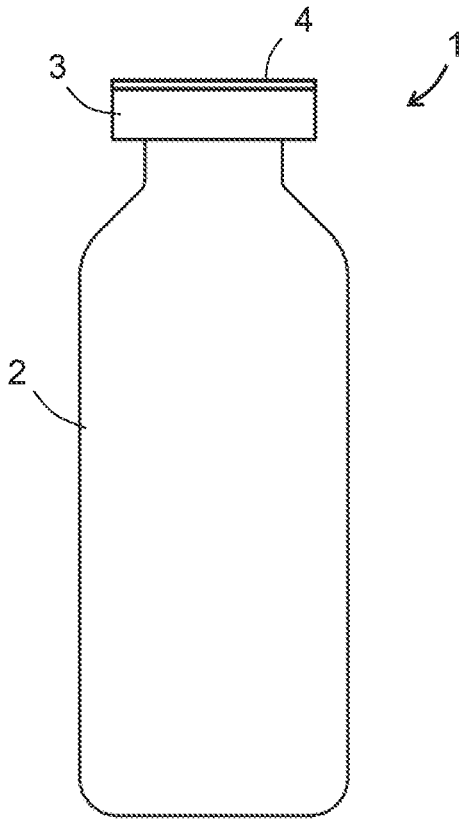
FIG. 1 is a front view of a hard container 1 of the first embodiment of the present invention.
Figure 2:
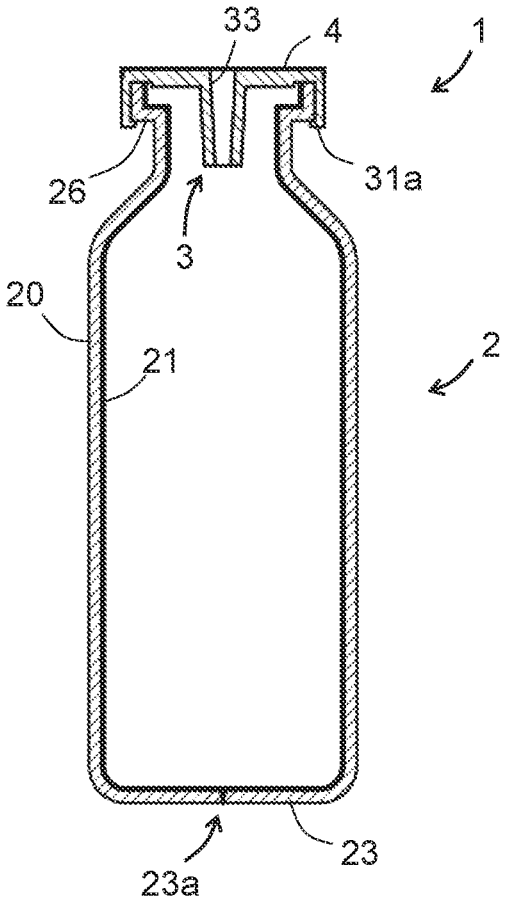
FIG. 2 is a cross-sectional view showing the hard container 1 in FIG. 1.
Figure 3:
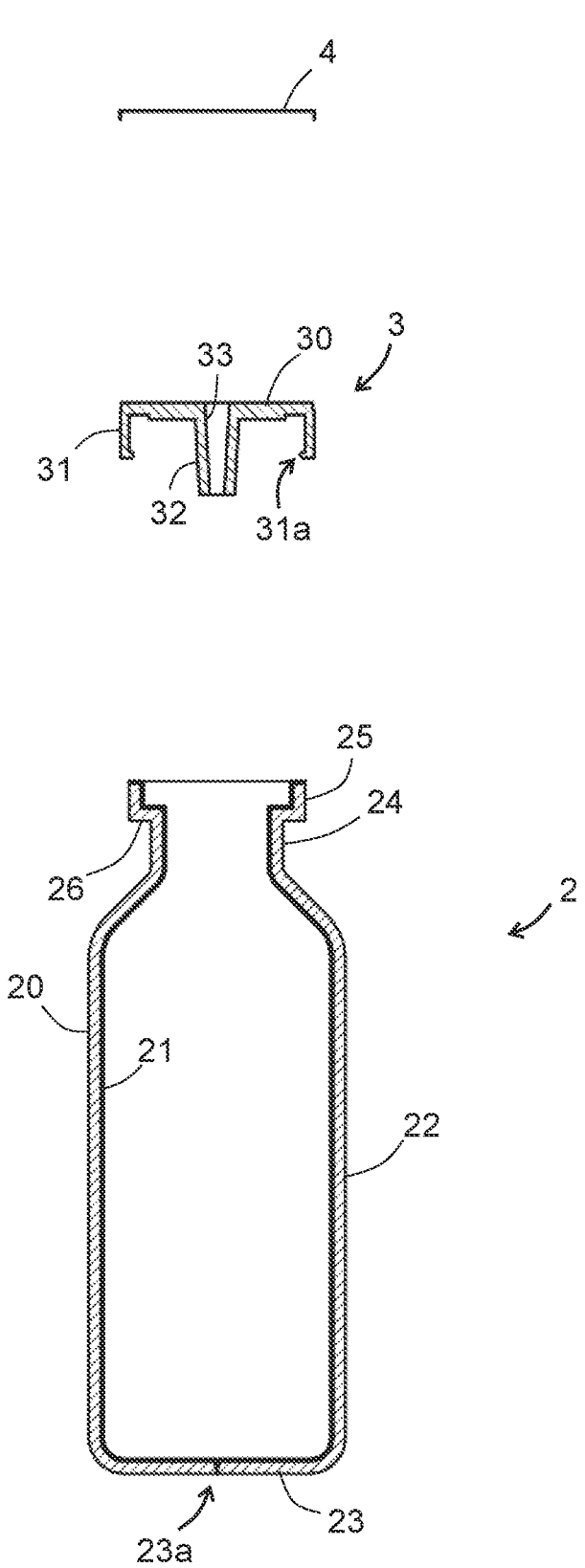
FIG. 3 is an exploded view of the hard container 1 in FIG. 1.

As shown in FIGS. 1 to 3, a hard container 1 of the first embodiment of the present invention has a container body 2, a cap 3, and a film 4. The hard container 1 of the present embodiment is a resin-made container (cartridge) for use with a nebulizer 100 (shown in FIG. 5) attached thereto as a suction device that is configured to spray suctioned content. In the present embodiment, the content is liquid (e.g., drug solution for asthma treatment). The hard container 1 is formed to be hard to protect the content and facilitate handling. Specific hardness of the hard container 1, especially the container body 2, will be described later.

The container body 2 is arranged as a delaminatable container having an outer shell 20 and an inner bag 21. The inner bag 21 of the container 2 contracts off the outer shell 20 as the content is reduced. The container body 2 is formed by blow-molding a cylindrical laminated parison. Blow-molding may be direct blow-molding or injection blow-molding.

Figure 4:
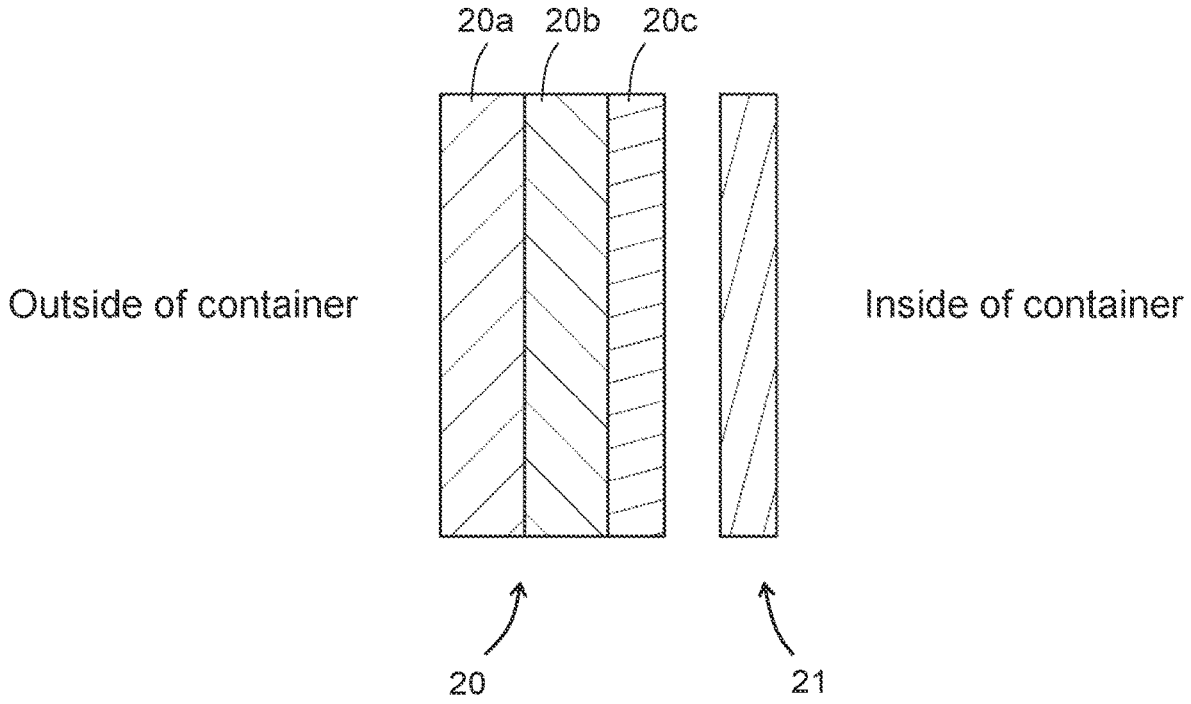
FIG. 4 illustrates a layer configuration of a container body 2 of the hard container 1 in FIG. 1.

As shown in FIG. 4, the outer shell 20 has a base layer 20*a*, an adhesive layer 20*b*, and an EVOH layer 20*c* in order from outside of the container. It should be noted that a thickness ratio of each later is not described accurately in FIG. 4.

Polyolefins such as low density polyethylene (LDPE), linear low density polyethylene (LLDPE), high density polyethylene (HDPE), polypropylene (PP), ethylene-propylene copolymer (EPR) and mixture thereof are cited as examples of constituent material of the base layer 20*a*. Preferably, the base layer 20*a* is homopolypropylene layer (hPP). The base layer 20*a* may be configured of single layer or multiple layers.

The adhesive layer 20*b* is the layer that adhere the base layer 20*a* to the EVOH layer 20*c* and is constituted by an adhesive resin. Acid-modified polyolefin resins (e.g., maleic anhydride-modified polyethylene and maleic anhydride-modified polypropylene) and the like are cited as examples of the adhesive resin. However, the adhesive layer 20*b* may not necessarily be provided when adhesiveness of the base layer 20*a* and the EVOH layer 20*c* is good.

The EVOH layer 20*c* is an innermost layer of the outer shell 20. The EVOH layer 20*c* is the layer that is constituted of an ethylene-vinyl alcohol copolymer (EVOH) resin, which is obtained by hydrolysis of ethylene and vinyl acetate copolymer. The content amount of ethylene of the EVOH resin is preferably 32 mol % or below to ensure hardness of the outer shell 20. Also, ethylene content of the EVOH resin is preferably 27 mol % or below. The EVOH layer 20*c* is used to enhance gas barrier property of the container body 2 and detachability of the inner bag 21.

The thickness ratio of EVOH layer 20*c* in the container body 2 is preferably 0.1 to 10%, more preferably 0.5 to 5.0%, and even more preferably 1.0 to 2.0%. The thickness ratio of the EVOH layer 20*c* is, specifically for example, 0.1, 0.5, 1.0, 1.5, 2.0, 2.5, 3.0, 3.5, 4.0, 4.5, 5.0, 6.0, 7.0, 8.0, 9.0, 10%, and can be in the range between the two values exemplified herein.

The inner bag 21 may be configured of single layer or multiple layers. Preferably, the inner bag 21 is constituted of the polyolefin layer. Non-modified polyolefin, acid-modified polyolefin and the like are cited as examples of constituent material of the inner bag 21. Low density polyethylene (LDPE), linear low density polyethylene (LLDPE), high density polyethylene (HDPE), polypropylene (PP), ethylene-propylene copolymer (EPR) and mixture thereof are cited as examples of polyolefin. More preferably, the inner bag 21 is low density polyethylene (LDPE). It should be noted that the inner bag 21 in the present embodiment does not preferably include the EVOH layer.

In addition, the thickness ration of the inner bag 21 in the container body 2 is preferably 5 to 25%, more preferably 10 to 20%, and even more preferably 12 to 16%. The thickness ratio of the inner bag 21 is, specifically for example, 5, 10, 11, 12, 13, 14, 15, 16, 17, 18, 19, 20, 25%, and can be in the range between the two values exemplified herein.

The container body 2 with a layer configuration as described above is bottomed cylindrical and has a body part 22, a bottom part 23, a neck part 24, and a mouth part 25, as shown in FIG. 1. The bottom part 23 is provided with an outside air introduction hole 23*a* that introduce outside air into between the outer shell 20 and the inner bag 21. Specifically, the outside air introduction hole 23*a* is provided on a pinch-off part that is formed when a bottom end of the laminated parison is interposed between split molds and crushed by them. A part of the inner bag 21 exposes from a crack of the outer shell 20 on the pinch-off part, and peel-off of this part from the outer shell 20 leads to formation of the outside air introduction hole 23*a*.

A diameter of the neck part 24 is smaller than that of the body part 22. Furthermore, the diameter of the mouth part 25 is larger than that of the neck part 24. Difference in diameter between the neck part 24 and the mouth part 25 forms an engagement part 26 to which the cap 3 is attached.

It should be noted that since the container body 2 constitutes the hard container 1, it is configured not to be recessed even if it is strongly pressed by fingers. Elastic modulus gradient (N/mm) of the container body 2 is preferably 20 N/mm or above. Furthermore, elastic modulus gradient of the container body 2 is more preferably 30 N/mm or above, and even more preferably 40 N/mm or above. Besides, elastic modulus gradient of the container body 2 is preferably 20 to 60 N/mm, more preferably 30 to 50 N/mm, and even more preferably 35 to 45 N/mm. Elastic modulus gradient of the container body 2 is, specifically for example, 20, 25, 30, 35, 40, 45, 50, 55, 60 N/mm, and can be in the range between the two values exemplified herein.

Herein, the above-mentioned elastic modulus gradient of the container body 2 is a value (N/mm) that shows a load needed to deform a test object by 1 mm and was measured in accordance with the following method.

Figure 10:
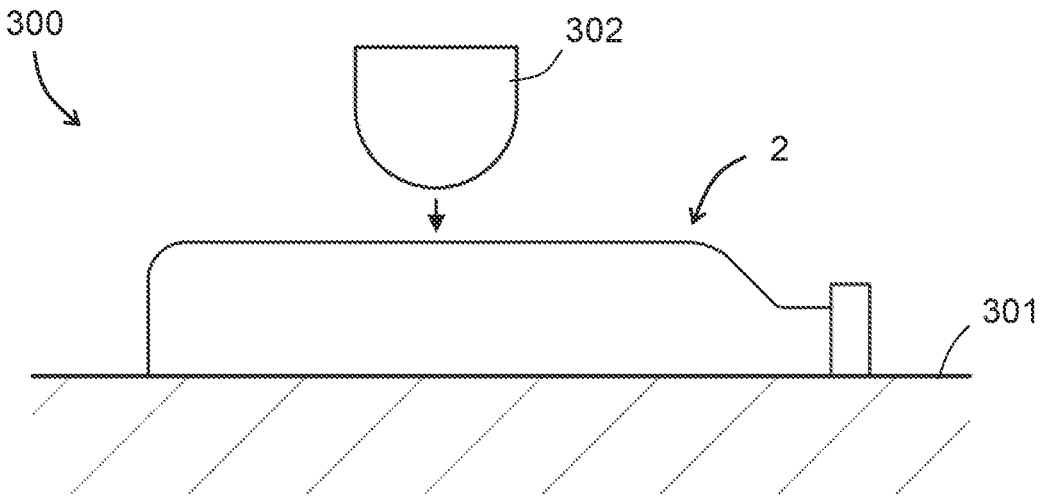
FIG. 10 illustrates a testing equipment 300 for measuring elastic modulus gradient of the container body 2.

As shown in FIG. 10, a testing equipment 300 has a base 301 and a load means 302. A specific example of the testing equipment 300 is TENSILON™ (tensile/compression testing machine).

First, the container body 2 was cut vertically along a parting line, and it was set on the base 301 as a measuring sample such that a cross-section is directed downwards. Defining that displacement before loading is 0 mm (a measurement star point) and a measurement end point is 10 mm, a side of the container body 2 was compressed at 20 mm/min from upwards by the load means 302. Then, load difference gradients to displacement difference (sampling values) were obtained within a plurality of sections between from the measurement start point to the measurement end point, and elastic modulus gradient was calculated by linearizing each gradient using least-squares method. It should be noted that the gradients in a vicinity of the measurement start point and the measurement end point are excluded due to its non-linearities.

As shown in FIG. 3, the cap 3 has a disk-shaped top part 30, an outer cylindrical part 31 that extends downwards from an outer edge part of the top part 30, and an inner cylindrical part 32 that extends downwards from a middle part of the top part 30. An engagement claw 31*a* protruding inwardly in a radial direction is formed on a lower edge of the outer cylindrical part 31. The cap 3 is mounted to the container body 2 by engagement of an engaging claw 31*a* of the cap 3 and an engagement part 26 of the container body 2. A mounting method of the cap 3 can also be a screw type unlike such a plug-in type. Furthermore, a through hole 33 through the top part 30 and the inner cylindrical part 32 is formed in the middle part of the cap 3. An inner peripheral surface of the through hole 33 is tapered such that the diameter narrows gradually downwards.

The cap 3 can be made of any resin. Polyolefins such as low density polyethylene (LDPE), linear low density polyethylene (LLDPE), high density polyethylene (HDPE), polypropylene (PP), ethylene-propylene copolymer (EPR) and mixture thereof are cited as examples of constituent material of the cap 3.

The film 4 is attached to an upper surface of the top part 30 of the cap 3, thereby sealing the hard container 1. For example, the film 4 is made of aluminum foil.

Furthermore, the content amount of the hard container 1 is 1 to 20 mL. The content amount of the hard container 1 is preferably 1 to 10 mL, and more preferably 3 to 5 mL. The content amount of the hard container 1 is, specifically for example, 1, 2, 3, 4, 5, 6, 7, 8, 9, 10, 15, 20 mL, and can be in the range between the two values exemplified herein.

(Nebulizer 100)

Figure 5:
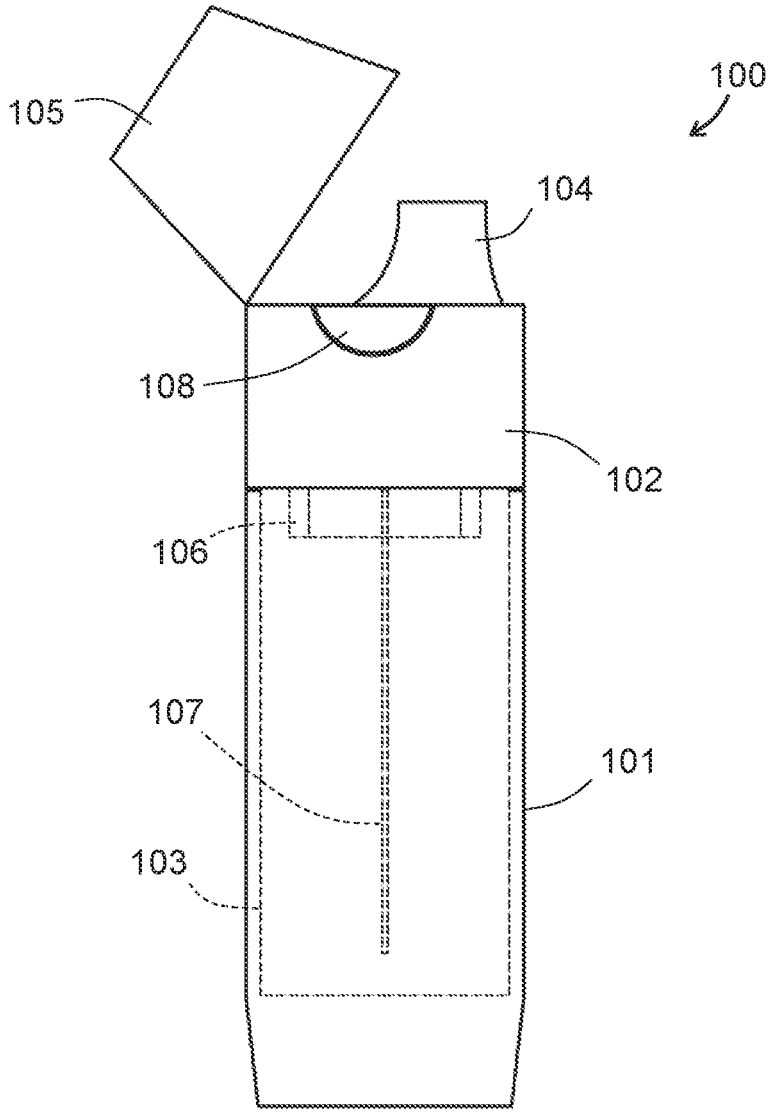
FIG. 5 is a schematic view showing a nebulizer 100 for use with the hard container 1 in FIG. 1 attached thereto.

As shown in FIGS. 5 to 8, the nebulizer 100 is the device for use with the hard container 1 having the constitution described above that is attached thereto, and it changes liquid stored in the hard container 1 (e.g., drug solution for asthma treatment) into mist-like liquid and sprays it. As shown in FIG. 5, the nebulizer 100 has an outer container 101, a nebulizing mechanism 102, a cylindrical part 103, a suction port 104, a suction port cover 105, a holding cylindrical part 106, a puncture needle 107, and a spray button 108. Since the invention disclosed in Japanese Unexamined Patent Application Publication No. 2016-527041 can be applied to such a nebulizer 100, an explanation of the specific configuration will be omitted.

(Spraying Device 200)

A spraying device 200 is configured by attachment of the nebulizer 100 to the above-mentioned hard container 1. Hereinafter, how to configure the spraying device 200 by attachment of the nebulizer 100 to the hard container 1 will be described using FIGS. 6 and 7.

Figure 6:
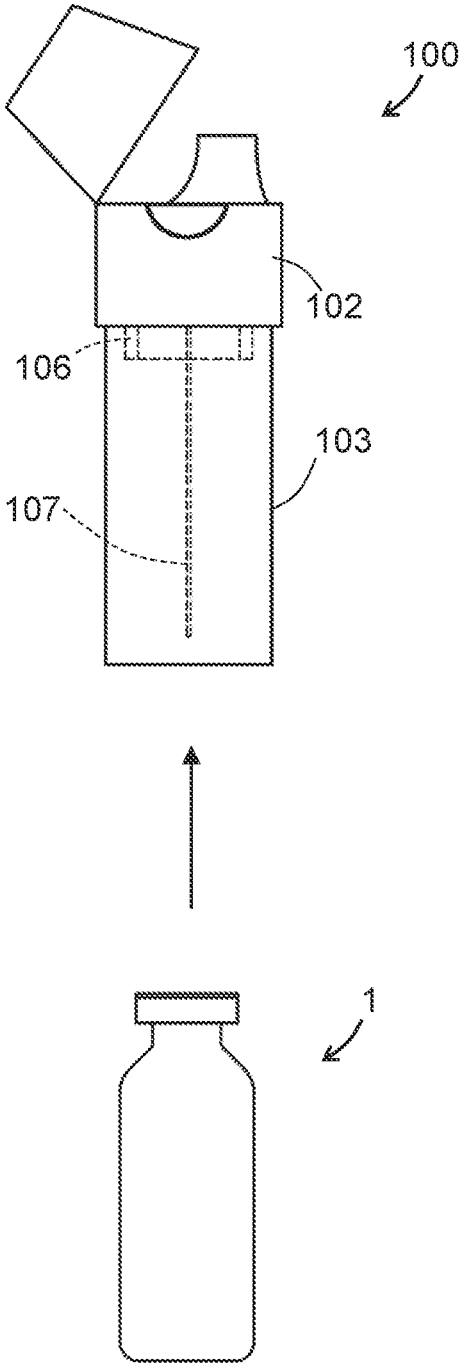
FIG. 6 illustrates how the nebulizer 100 is attached to the hard container 1 in FIG. 1.

To attach the nebulizer 100 to the hard container 1, the nebulizer 100 is first put on the hard container 1 with the outer container 101 removed as shown in FIG. 6, and then the hard container 1 is inserted straight into the inside of the cylindrical part 103. Once the hard container 1 is inserted deeply, the puncture needle 107 of the nebulizer 100 punches the film 4 of the hard container 1, and the puncture needle 107 reaches the inside of the inner bag 21 via the through hole 33 that the cap 3 is provided with. Consequently, the content of the hard container 1 can be suctioned by the nebulizing mechanism 102. It should be noted that the hard container 1 of the present embodiment is tapered such that the diameter of the inner peripheral surface of the through hole 33 formed by the inner cylindrical part 32 of the cap 3 narrows gradually downwards. Thus, the puncture needle 107 can be inserted appropriately into the inside of the container body 2 and can be positioned after the insertion (shown in FIG. 8). The hard container 1 inserted deeply into the cylindrical part 103 is held by the holding cylindrical part 106. In the present embodiment, a tip of the puncture needle 107 does not reach a lowest position of the inner bag 21. However, since the inner bag 21 contracts as the content is reduced, the content can be sprayed until it is exhausted.

Figure 7:
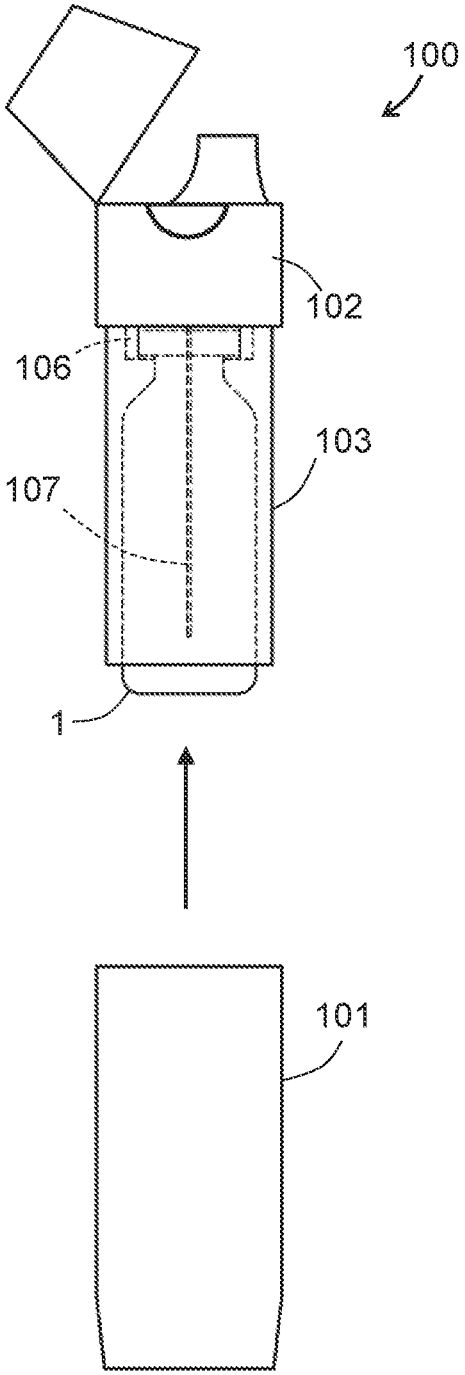
FIG. 7 illustrates how an outer container 101 is attached to the nebulizer 100 from a state as in FIG. 6.
Figure 8:
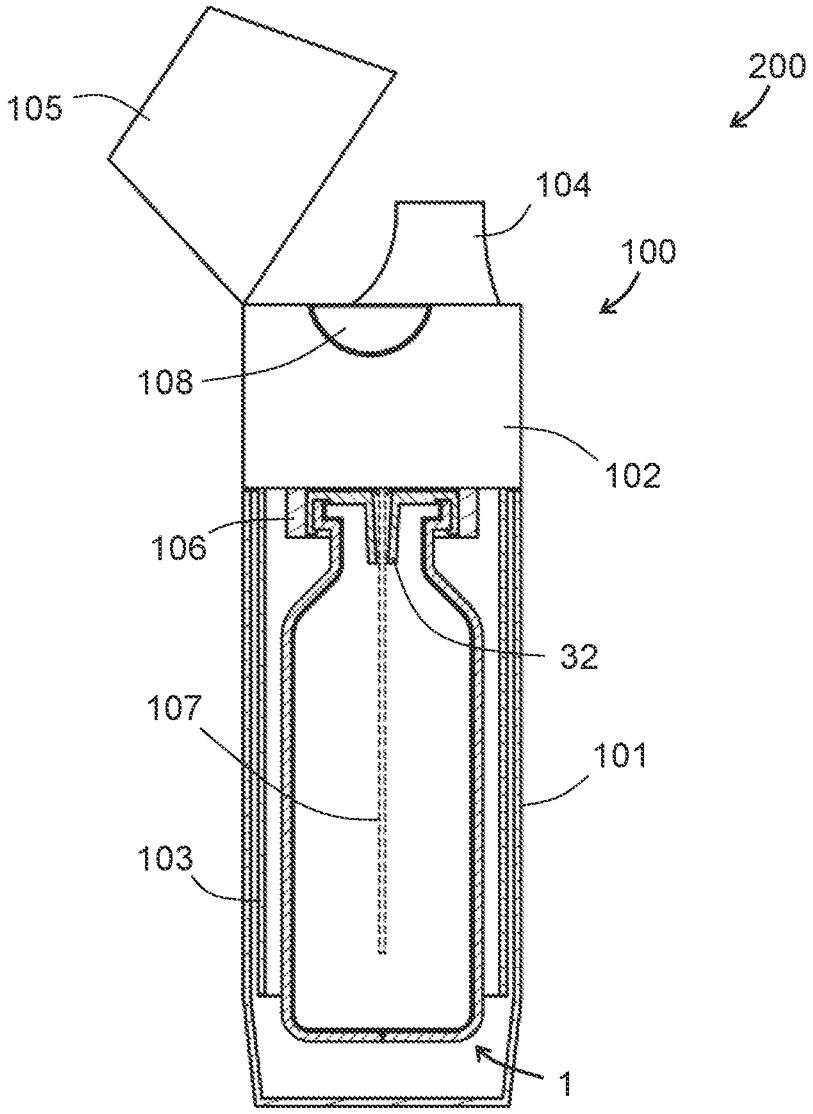
FIG. 8 is a cross-sectional view showing a spraying device 200 configured by attachment of the nebulizer 100 in FIG. 5 to the hard container 1 in FIG. 1.

Then, the outer 101 is attached to the nebulizing mechanism 102 as shown in FIG. 7. Thus, the hard container 1 is housed inside of the outer container 101.

When the spraying device 200 configured as described above is used, the outer container 101 is rotated relative to the nebulizing mechanism 102. Thus, a driving spring (not shown) that the nebulizing mechanism 102 comprises is energized and a certain amount of the liquid stored in the hard container 1 is suctioned into a compression space (not shown). Then, a certain amount of the liquid is sprayed by opening the suction port cover 105 and pressing the spray button 108.

The spray amount for one time by pressing the spray button 108 of the nebulizer 100 is preferably 5 to 100 μL, more preferably 10 to 50 μL, and even more preferably 20 to 40 μL. The spray amount for one time is, specifically for example, 5, 10, 15, 20, 25, 30, 35, 40, 45, 50, 75, 100 μL, and can be in the range between the two values exemplified herein.

As mentioned above, as for the container body 2 of the hard container 1 in the present embodiment, providing the innermost layer of the outer shell 20 with the EVOH layer 20*c* and not providing the inner bag 21 with the EVOH layer can ensure flexibility of the inner bag 21 as well as keep gas barrier property and detachability of the hard container 1. Ensuring flexibility of the inner bag 21 enables appropriate contraction of the inner bag 21 and improvement of sprayability even if the hard container 1 has the small content amount (e.g., 1 to 20 mL) and the small spray amount for one time (e.g., 5 to 100 μL).

Furthermore, since the elastic modulus gradient of the container body 2 is 30 N/mm or above, a strength of the hard container 1 can be ensured, a crush of the container body 2 due to plug-in of the cap 3 can be prevented, and the liquid stored can be protected appropriately.

The Second Embodiment

Hereinafter, a discharging device 500 as a device comprising the hard container 1 of the second embodiment of the present invention will be explained with reference to FIG. 9.

The hard container 1 of the present embodiment is similar to that of the first embodiment. In particular, since the layer configuration of the container body 2 is the same, its description will be omitted. However, the hard container 1 of the present invention is different from that of the first embodiment in that it does not comprise the cap 3 and the film 4.

The hard container 1 of the present invention is used as a discharging device 500, which is constituted of the hard container 1 and a pump 400 attached thereto as a suction device that is configured to discharge suctioned content. For that reason, a male screw part 25*a* for attachment of the pump 400 is formed on the outer peripheral surface of the mouth part 25 of the container body 2.

Figure 9:
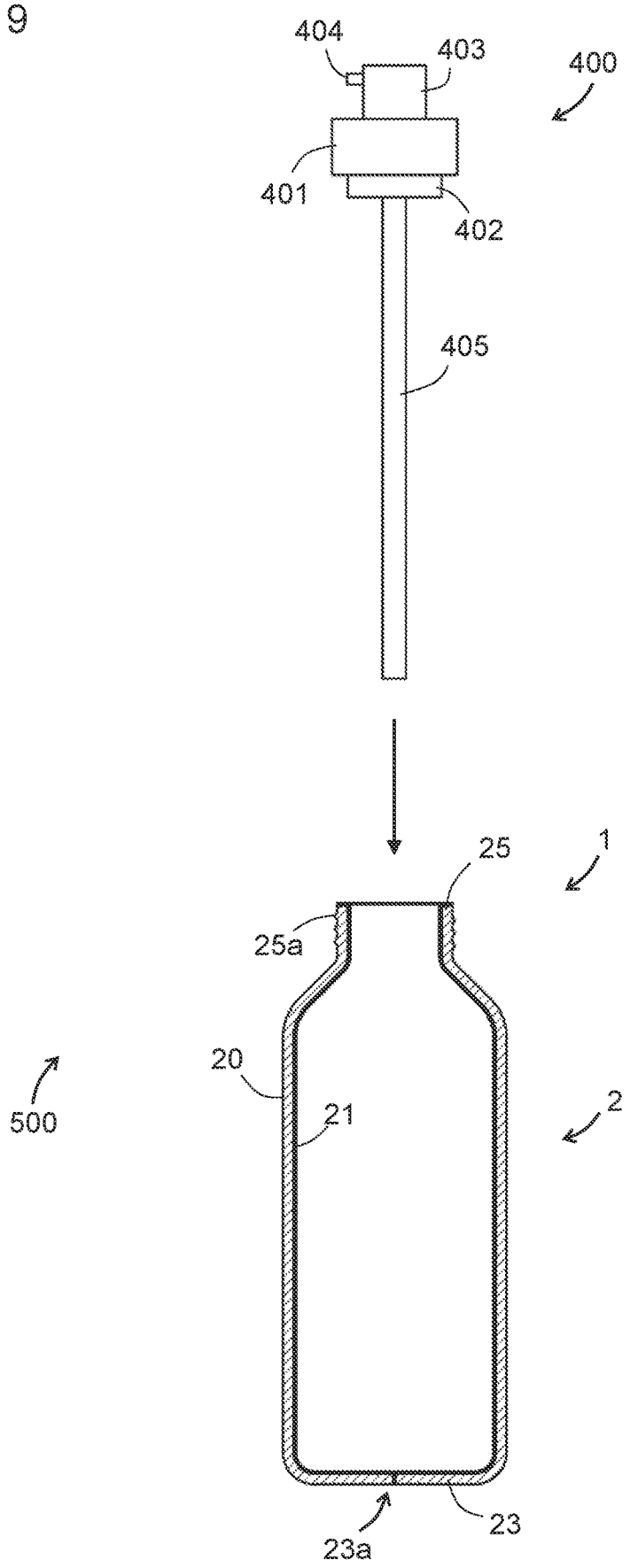
FIG. 9 is a cross-sectional view of the second embodiment of the present invention showing a discharging device 500 configured by attachment of a pump 400 to the hard container 1.

The pump 400 shown in FIG. 9 has a cylindrical part 401, a cylinder part 402, a piston part 403, a nozzle 404, and a tube 405. A pump mechanism constituted of an elastic member and a valve is included in the cylinder part 402, and the inner space is communicated to the nozzle 404 and the tube 405. Any conventionally known configuration can be applied to the specific configuration of the pump 400.

To attach the pump 400 to the hard container 1, it is needed that the tube 405 is inserted into the inside of the hard container 1 and a female screw part (not shown) formed on the inner surface of the cylindrical part 401 is screwed to the male screw part 25*a* formed on the mouth part 25 of the container body 2. It should be noted that the outer diameter of the cylinder part 402 substantially coincides with the inner diameter of the mouth part 25.

The discharging device 500 configured as described above can discharge via the nozzle 404 the content that is suctioned through the tube 405 by sliding the piston part 403 of the pump 400 relative to the cylinder part 402.

Even when the pump 400 is attached to the hard container 1 of the present invention and is used together as the discharging device 500 as described above, providing the innermost layer of the outer shell 20 with the EVOH layer 20*c* and not providing the inner bag 21 with the EVOH layer can ensure flexibility of the inner bag 21 as well as gas barrier property and detachability of the hard container 1.

This invention can also be implemented in the following aspects.

In the embodiments described above, the suction device attached to the hard container 1 is the nebulizer 100 or the pump 400. However, any device can be used unless it is what discharges or sprays the content suctioned from the hard container 1.

In the embodiment described above, the inner bag 21 does not comprise the EVOH layer. However, if the flexibility of the inner bag 21 can be ensured, the inner bag 21 may be provided with the EVOH layer.

REFERENCE SIGN LIST

1: hard container, 2: container body, 3: cap, 4: film, 20: outer shell, 20*a*: base layer, 20*b*: adhesive layer, 20*c*: EVOH layer, 21: inner bag, 22: body part, 23: bottom part, 23*a*: outside air introduction part, 24: neck part, 25: mouth part, 25*a*: male screw part, 26: engagement part, 30: top part, 31: outer cylindrical part, 31*a*: engagement claw, 32: inner cylindrical part, 33: through hole, 100: nebulizer (suction device), 101: outer container, 102: nebulizing mechanism, 103: cylindrical part, 104: suction port, 105: suction port cover, 106: holding cylindrical part, 107: puncture needle, 108: spray button, 200: spraying device, 300: testing equipment, 301: base, 302: load means, 400: pump (suction device), 401: cylindrical part, 402: cylinder part, 403: piston part, 404: nozzle, 405: tube, 500: discharging device

The invention claimed is:

1. A hard container configured to be used with a suction device attached thereto, the suction device configured to discharge or spray suctioned content, the hard container comprising a container body having an outer shell and an inner bag, wherein the container body is configured such that the inner bag contracts as the content is reduced, the outer shell comprises a base layer, an adhesive layer, and an EVOH layer in order from outside of the container, the EVOH layer is an innermost layer of the outer shell, an elastic modulus gradient of the container body is 20 N/mm or above, the base layer comprises a polyolefin layer, the container body is provided with an outside air introduction hole that introduces outside air between the outer shell and the inner bag, the outside air introduction hole is provided on a pinch-off part that is formed when a bottom end of a laminated parison is interposed between split molds and crushed by the split molds, and the inner bag is provided to cover an open end of the outer shell.

2. The hard container of claim 1, wherein the inner bag does not comprise an EVOH layer.

3. The hard container of claim 2, wherein the inner bag is constituted of a polyolefin layer.

4. The hard container of claim 1, wherein the content is 1 to 10 mL.

5. A device comprising the hard container of claim 1, comprising a suction device attached to the hard container, wherein the suction device comprises:

a nebulizing mechanism, an outer container, and a puncture needle, the nebulizing mechanism is attached to the hard container and configured to discharge or spray suctioned content suctioned from the hard container; the outer container is configured to attach to and remove from the nebulizing mechanism; the hard container has a cap mounted to the container body, and a film attached to an upper surface of the cap to seal the hard container; the cap has a through hole that enables the puncture needle to punch the film and reach the inside of the inner bag via the through hole, thereby ensuring that the content of the hard container can be suctioned by the nebulizing mechanism.

6. The device of claim 5, wherein the suction device has a discharge or spray amount of 10 to 50 μL for one time.

7. The hard container of claim 1, further comprising:

a plug-in cap attached to the container body, wherein the container body has a mouth part and a neck part having a diameter smaller than the mouth part, an engagement part to which the cap is attached is formed by a difference in diameter between the neck part and the mouth part, the cap has an outer cylindrical part having an engagement claw protruding inwardly in a radial direction, the cap is attached to the container body by engagement between the engagement claw and the engagement part, an elastic modulus gradient of the container body is 30 N/mm or above, and a content amount of the hard container is 1 to 20 mL.

8. The hard container of claim 7, wherein the inner bag is provided to cover an open end of the outer shell, and the inner bag is sandwiched between the cap and the outer shell in an open end of the container body.

9. The hard container of claim 7, wherein a lower surface of the mouth part is perpendicular to an outer circumferential surface of the mouth part.

10. The hard container of claim 1, further comprising:

a plug-in cap attached to the container body, wherein the container body has a mouth part and a neck part having a diameter smaller than the mouth part, an engagement part to which the cap is attached is formed by a difference in diameter between the neck part and the mouth part, the cap has a disk-shaped top part, an outer cylindrical part that extends downwards from an outer edge part of the top part and an inner cylindrical part that extends downwards from a middle part of the top part, the outer cylindrical part has an engagement claw protruding inwardly in a radial direction, the cap is attached to the container body by engagement between the engagement claw and the engagement part, a through hole through the top part and the inner cylindrical part is formed in the middle part of the cap, an elastic modulus gradient of the container body is 30 N/mm or above, and a content amount of the hard container is 1 to 20 mL.

11. The hard container of claim 1, wherein an ethylene content of an EVOH resin that constitutes the EVOH layer is 32 mol % or below and a thickness ratio of the EVOH layer in the container body is 0.1 to 10%.

12. The hard container of claim 1, wherein the base layer further comprises a homopolypropylene layer.

13. The hard container of claim 1, wherein a thickness ratio of the inner bag in the container body is 5 to 25%.

14. The hard container of claim 1, wherein a content amount of the hard container is 1 to 20 mL.

15. The hard container of claim 1, wherein the container body is formed by direct blow-molding a laminated parison and the outside air introduction hole is provided on the pinch-off part that is formed when the bottom end of the laminated parison is interposed between the split molds and crushed by the split molds in the direct blow-molding.

* * * * *